US006022171A

United States Patent [19]

Munoz

[11] Patent Number: 6,022,171

[45] Date of Patent: Feb. 8, 2000

[54] APPARATUS AND METHOD FOR PREPARING A SITE AND FINISHING POURED CONCRETE

[75] Inventor: Armando G. Munoz, 289 W. Land Way, Marietta, Ga. 30064

[73] Assignee: Armando G. Munoz, Marietta, Ga.

[21] Appl. No.: 09/173,208

[22] Filed: Oct. 15, 1998

Related U.S. Application Data

[60] Provisional application No. 60/062,378, Oct. 15, 1997.

[51] Int. Cl.[7] ..... E01C 19/22

[52] U.S. Cl. ..... 404/124; 404/83; 404/120; 404/122

[58] Field of Search ..... 404/37, 84.5, 120, 404/122, 124, 83

[56] References Cited

U.S. PATENT DOCUMENTS

| | | | |
|---|---|---|---|
| 643,630 | 2/1900 | Bush . | |
| 773,616 | 11/1904 | Wilson . | |
| 865,162 | 9/1907 | Coldwell | 404/84.5 |
| 2,261,893 | 11/1941 | Wolfard | 404/37 |
| 2,734,433 | 2/1956 | Brown | 404/120 |
| 4,302,127 | 11/1981 | Hodson | 404/102 |
| 4,610,567 | 9/1986 | Hosking | 404/124 |
| 4,723,870 | 2/1988 | Martinez | 404/122 |
| 5,039,249 | 8/1991 | Hansen et al. | 404/84 |
| 5,129,803 | 7/1992 | Nomura et al. | 404/102 |
| 5,288,167 | 2/1994 | Gaffard et al. | 404/84.05 |
| 5,511,900 | 4/1996 | Macku | 404/84.1 |
| 5,556,226 | 9/1996 | Hohmann, Jr. | 404/84.1 |
| 5,567,075 | 10/1996 | Allen | 404/84.5 |

*Primary Examiner*—Thomas B. Will
*Assistant Examiner*—Raymond W Addie
*Attorney, Agent, or Firm*—R. Stevan Coursey; Troutman Sanders LLP

[57] ABSTRACT

A site preparation/concrete finishing apparatus for operation in an area having a base surface above which concrete reinforcing elements have been positioned prior to pouring of concrete within the area and for use in finishing concrete poured within the area. The site preparation/concrete finishing apparatus comprises a movable vehicle having at least one lift arm, a plurality of specially-tailored wheels for supporting the movable vehicle entirely within the area in continuous contact with the surface and for enabling continuous movement of the movable vehicle relative to the surface absent damage to the concrete reinforcing elements beneath the movable vehicle, and a concrete finishing device connected to the lift arm for fine grading and leveling of the area and for screeding and floating concrete poured within the area. Each wheel of the plurality of wheels includes a hub and a plurality of members extending radially therefrom. Each member of the plurality of members has a first end near the hub and a distal second end, and includes an arcuate surface proximate the second end. Each member also tapers over at least a portion of the distance between the first and second ends. The arcuate surface of each member aids in preventing the trapping of a concrete reinforcing member between the base surface and the site preparation/concrete finishing apparatus. The tapered portion of each member tends to direct a concrete reinforcing member contacted by the member slidably away from a longitudinal axis of the member.

21 Claims, 7 Drawing Sheets

FIG. 4
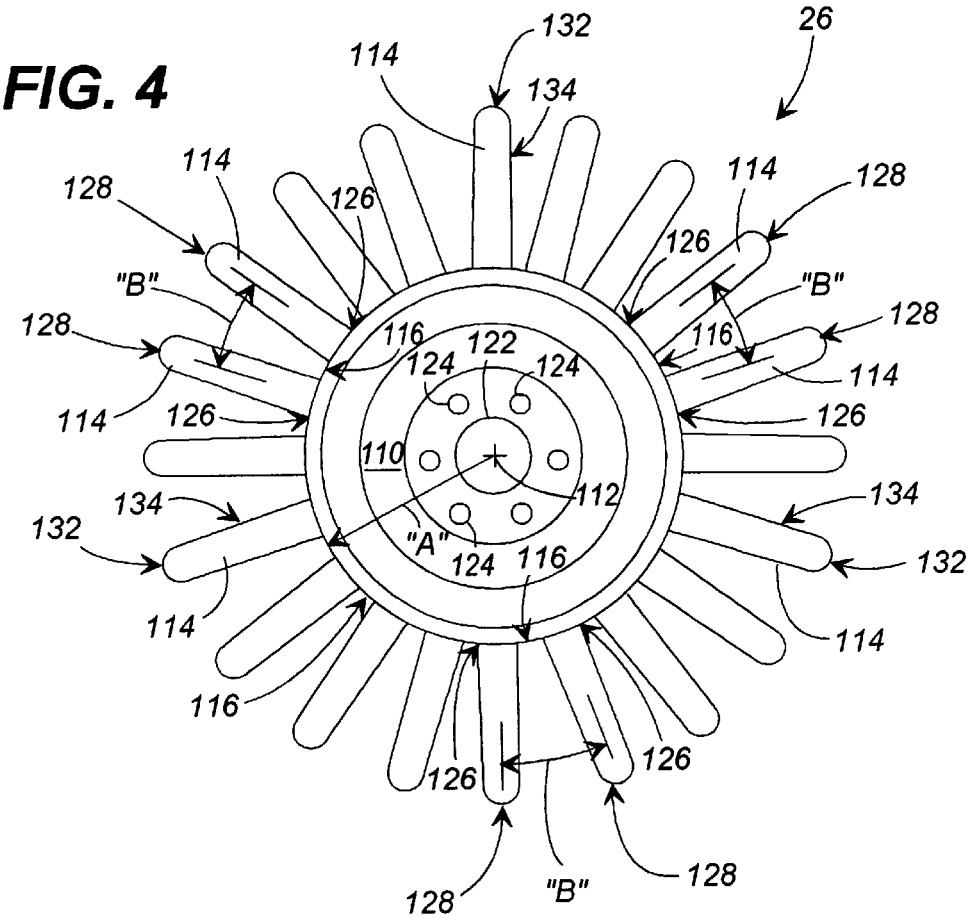
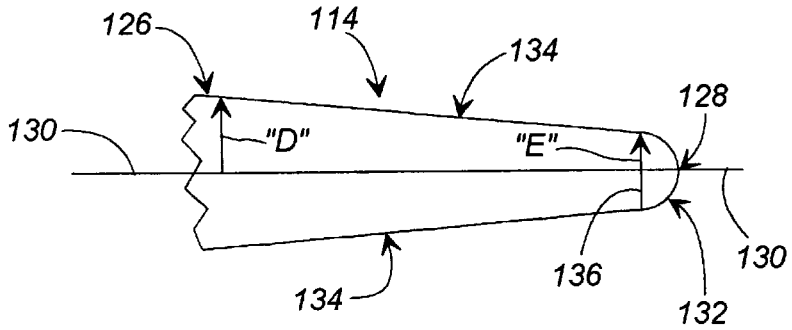
FIG. 5
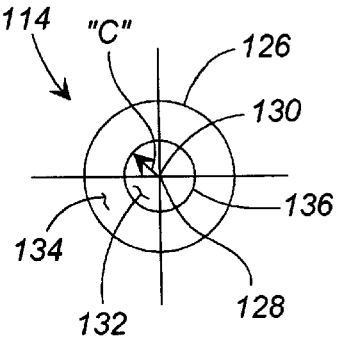
FIG. 6

APPARATUS AND METHOD FOR PREPARING A SITE AND FINISHING POURED CONCRETE

This application claims benefit of Provisional Application Ser. No. 60/862,378 filed Oct. 15, 1997.

FIELD OF THE INVENTION

This invention relates generally to the field of pouring concrete, and in its preferred embodiment, to apparatuses and methods for preparing a site and finishing poured concrete.

BACKGROUND OF THE INVENTION

For many years, the construction industry has relied on concrete as a material of choice for the construction of a variety of structures, including columns and slabs of buildings, roadbeds, and driveways. Such reliance is the result of concrete's structural properties, ready availability, and relative cost when compared with other building materials. In use, concrete is generally poured into forms which are pre-positioned and pre-shaped to define the location and contour of the structure to be fabricated from the concrete. To improve the ultimate strength of the resulting concrete structure, steel reinforcing bars and/or steel reinforcing wire are positioned within the forms prior to pouring of the concrete into the forms. With slabs, roadbeds, and driveways, the concrete, once poured, is "finished" by a first process known as "screeding" to even out, or level, the upper surface of the poured concrete at a desired elevation, typically, at the top edge of the forms. After screeding, the concrete is further finished by a second process known as "floating" to cause the aggregate within the concrete to settle away from the upper surface, thereby creating a smooth, aesthetically-appealing upper surface.

Often, concrete is screeded by workers dragging a piece of wood across the top edge of the forms and is floated by workers moving a planar panel back and forth across the upper surface until the aggregate is sufficiently settled away from the concrete's upper surface. Unfortunately, such hand-screeding and hand-floating are slow, labor intensive processes and can substantially increase the construction cost of a concrete structure. In an attempt to overcome the disadvantages of hand-screeding and hand-floating, a number of inventors have devised machines to assist workers in the performance of these tasks. For instance, in U.S. Pat. No. 5,039,239 issued to Hansen et al., an apparatus for screeding or trowelling concrete includes a turret mounted on a mobile frame and a telescopic boom extendable from the rotatable turret. Screed and trowel attachments are coupleable to the end of the telescopic boom for screeding and trowelling concrete poured in an area reachable by the end of the telescopic boom. While the Hansen apparatus appears to aid in overcoming some of the disadvantages of hand-screeding and hand-floating, the Hansen apparatus suffers, itself, from the disadvantage that it can screed and trowel poured concrete only in an area reachable by the telescopic boom. Thus, if an area of poured concrete not reachable by the telescopic boom must be screeded or trowelled, the mobile frame must be moved to a new, more appropriate, location and be re-leveled at the new location before screeding or trowelling can continue. The necessary re-locating and re-leveling of the Hansen apparatus forces an area of poured concrete to be poured and finished in sections or "batches" (i.e., as part of a "batch process") because concrete pouring must stop temporarily during the relocating and re-leveling operations. Such "batch processing" of concrete is excessively time-consuming and increases construction costs.

There is a need, therefore, in the industry for an apparatus which enables continuous finishing of concrete without requiring repeated relocation and re-leveling and which addresses other related, and unrelated, problems.

SUMMARY OF THE INVENTION

Briefly described, the apparatus of the present invention comprises, in a preferred form, a site preparation/concrete finishing apparatus for preparing a site to receive poured concrete and for finishing the poured concrete. The apparatus includes a movable vehicle and a concrete finishing device connected thereto, for operation within an area to receive concrete (i.e., the "site") which has a base surface above which at least one concrete reinforcing element is present. The concrete finishing device has a screed blade which enables fine grading during site preparation and finishing of the poured concrete. The movable vehicle further includes a plurality of wheels which support the movable vehicle in contact with the base surface and which enable movement of the movable vehicle within the confines of the area absent contact with a concrete reinforcing element that potentially damages the concrete reinforcing element. Each wheel includes a plurality of base surface-contacting members which extend from the wheel. The base surface-contacting members have a longitudinal axis and a portion which is configured to direct a concrete reinforcing element in a direction generally away from the longitudinal axis upon contact with the concrete reinforcing element. The concrete finishing device includes a reciprocating float assembly having a float member which translates relative to the movable vehicle in a first direction for a first period of time and then in a second direction for a second period of time.

According to a method of preparing a site and finishing poured concrete, the present invention comprises the positioning of a movable site preparation/concrete finishing apparatus having a plurality of wheels and a concrete finishing device within the confines of an area to receive concrete. The site preparation/concrete finishing apparatus moves in a rearward direction within the confines of the area to fine grade and level the area's base surface. Because the site preparation/concrete finishing apparatus moves in a rearward direction and because the screed blade of the concrete finishing device is located in front of the movable vehicle, the wheels do not create marks or ruts in the freshly graded and leveled base surface. After fine grading, the area is configured to include at least one concrete reinforcing element located above the base surface. Then, the site preparation/concrete finishing apparatus is repositioned within the confines of the area with the plurality of wheels in contact with the base surface at a location where pouring of the concrete is to begin. Next, concrete is poured within the area between the front of the movable vehicle and the concrete finishing device. The concrete is finished (i.e., screeded and floated) by the concrete finishing device as the movable vehicle moves in a rearward direction. Because the movable vehicle moves in a rearward direction and because the screed blade of the concrete finishing device is located in front of the movable vehicle, the wheels do not create marks or ruts in the freshly screeded and finished poured concrete.

In the event that contact occurs between a wheel of the site preparation/concrete finishing apparatus and a concrete reinforcing element, at least a portion of the concrete reinforcing element is displaced by the site preparation/concrete finishing apparatus from an initial first position to a temporary second position in a manner that enables the concrete reinforcing element to substantially resume the initial first position after cessation of contact with the wheel of the site preparation/concrete finishing apparatus. Because the site preparation/concrete finishing apparatus temporarily displaces the concrete reinforcing element and does not harm the concrete reinforcing element, the site preparation/concrete finishing apparatus moves continuously within the area and enables the continuous pouring and finishing of concrete. Since the processing of the concrete is continuous, construction projects such as roadbeds, building slabs, and driveways are completed in a fast, cost-effective manner.

Accordingly, it is an object of the present invention to provide an apparatus which enables the non-stop, continuous pouring, and finishing of concrete within an area at a desired elevation and which continuously translates entirely within the same area as the pouring, and finishing operations progress.

Another object of the present invention is to provide an apparatus which enables the non-stop, continuous pouring, and finishing of concrete at a desired elevation within an area having concrete reinforcing elements (including, for example and not limitation, reinforcing wire, reinforcing bars, etc.) and which continuously moves entirely within the same area as the pouring, and finishing operations progress without damaging the concrete reinforcing elements.

Still another object of the present invention is to provide an apparatus which enables the non-stop, continuous pouring, and finishing of concrete within an area at a desired elevation relative to the elevation of a laser beacon and which continuously moves entirely within the same area as the pouring and finishing operations progress.

Still another object of the present invention is to provide apparatuses which enable the non-stop, continuous pouring, and finishing of concrete within an area at a desired elevation and which are employable by a conventional front-end loader or substantially similar construction vehicle.

Still another object of the present invention is to provide an apparatus which enables the fine grading and leveling of the dirt base surface of an area which is to receive poured concrete.

Other objects, features, and advantages of the present invention will become apparent upon reading and understanding the present specification when taken in conjunction with the appended drawings.

BRIEF DESCRIPTION OF THE DRAWINGS

FIG. 4 is a side, elevational view of a wheel of the site preparation/concrete finishing apparatus of FIG. 1.

FIG. 5 is a partial, side elevational view of a member of a wheel of FIG. 4.

FIG. 6 is an end elevational view of a member of the wheel of FIG. 4.

DETAILED DESCRIPTION OF THE PREFERRED EMBODIMENT

Figure 1:
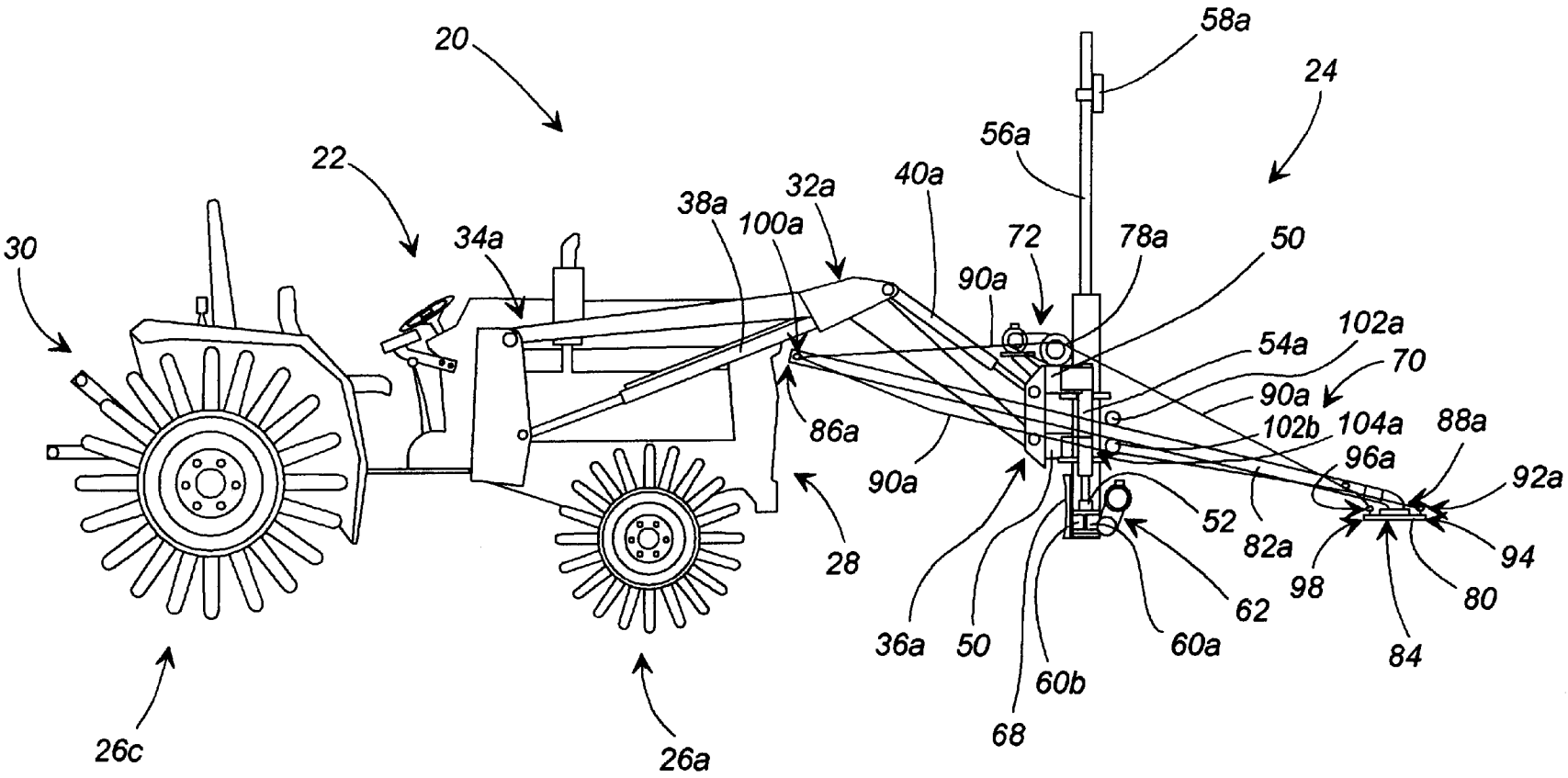
FIG. 1 is a side, elevational view of a site preparation/concrete finishing apparatus in accordance with a preferred embodiment of the present invention.

Referring now to the drawings, in which like numerals represent like components throughout the several views, FIG. 1 displays a site preparation/concrete finishing apparatus 20 in accordance with a preferred embodiment of an apparatus of the present invention. The site preparation/concrete finishing apparatus 20 comprises a movable vehicle 22, a concrete finishing device 24 coupled to the movable vehicle 22, and a plurality of wheels 26 mounted to the vehicle 22. The movable vehicle 22 has a front end 28 and a rear end 30. Wheels 26*a*, 26*b* (also referred to herein as "front wheels 26*a*, 26*b*") are mounted for rotation near the front end 28 of the vehicle 22 and wheels 26*c*, 26*d* (also referred to herein as "rear wheels 26*c*, 26*d*") are mounted for rotation near the rear end 30 of the vehicle 22. The movable vehicle 22 also has first and second lift arms 32*a*, 32*b* having first ends 34*a*, 34*b*, respectively, which pivotally connect to the movable vehicle 22 and second ends 36*a*, 36*b*, respectively, which are positioned, generally, forward of the front end 28 of the vehicle 22. Additionally, the movable vehicle 22 has first lift arm hydraulic cylinders 38*a*, 40*a* and second lift arm hydraulic cylinders 38*b*, 40*b* which enable an operator of the movable vehicle 22 to selectively horizontally and vertically position the second ends 36*a*, 36*b* of the lift arms 32*a*, 32*b* at a plurality of locations relative to the vehicle 22 and relative to a surface on which the movable vehicle 22 operates. In accordance with the preferred embodiment of the present invention, the movable vehicle 22 is, known to those reasonably skilled in art, as a "front-end loader". The operation of such a movable vehicle 22 is well-known in the art. It is understood that the scope of the present invention includes other types or forms of movable vehicles 22 having the functionality described and required herein.

Figure 2:
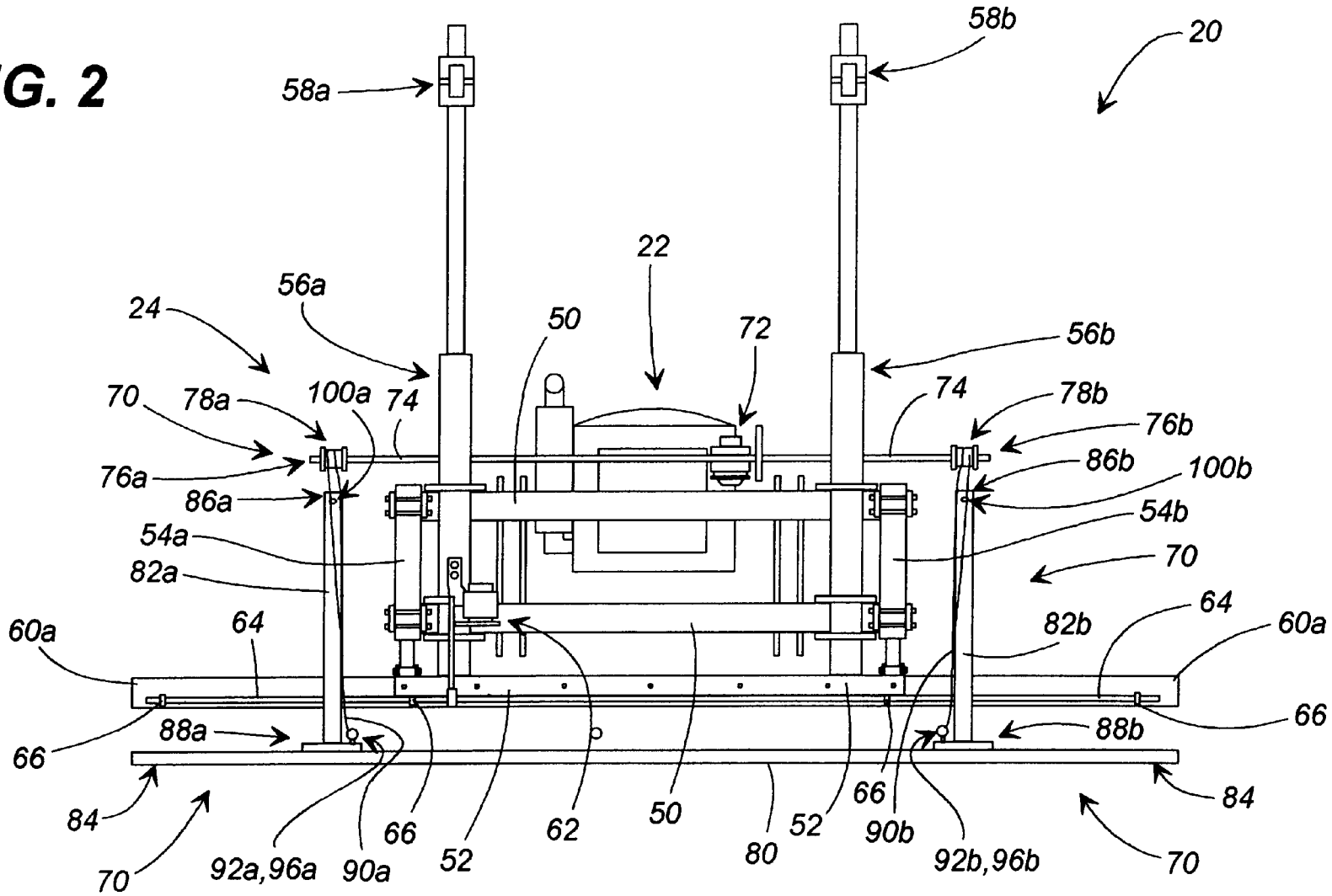
FIG. 2 is a partial, front elevational view of the site preparation/concrete finishing apparatus of FIG. 1.
Figure 3:
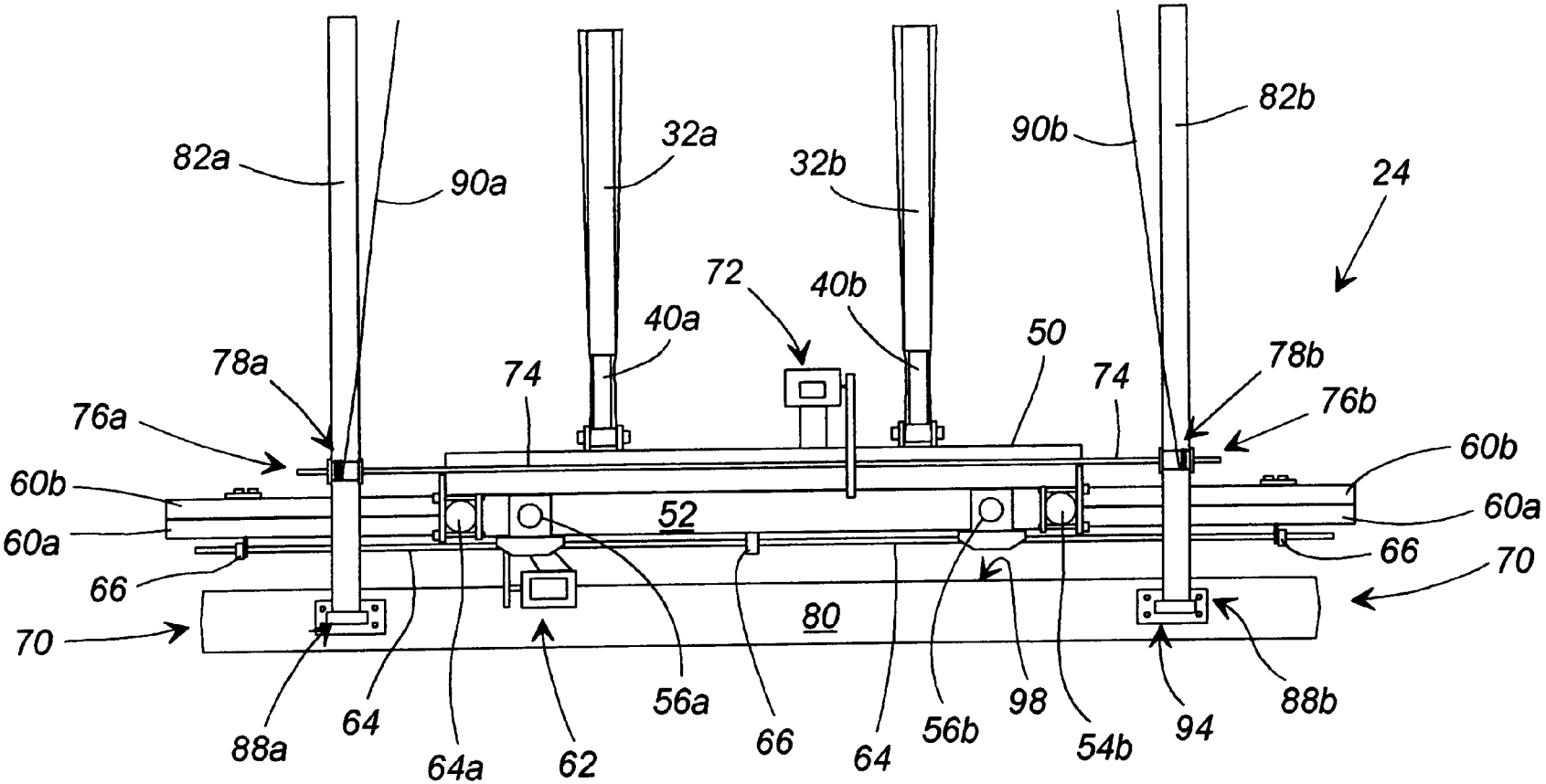
FIG. 3 is a partial, top plan view of a concrete finishing device of the site preparation/concrete finishing apparatus of FIG. 1.

The concrete finishing device 24, shown also in FIGS. 2 and 3, comprises a first frame 50 which pivotally mounts to the second ends 36*a*, 36*b* of the first and second lift arms 32*a*, 32*b* and a second frame 52 which connects to the first frame 50 via first and second finishing device hydraulic cylinders 54*a*, 54*b* which extend therebetween. Because the first and second finishing device hydraulic cylinders 54*a*, 54*b* are continuously extendable and retractable, the second frame 52 (i.e., and components connected to the second frame 52) is locatable at a plurality of positions having different vertical elevations relative to the first frame 50 and relative to the surface on which the movable vehicle 22 operates. The concrete finishing device 24 further comprises first and second laser receivers 56*a*, 56*b* having first ends which rigidly mount to an upper portion of the second frame 52 and second ends which extend, from the second frame 52, in a substantially upward, vertical direction. The first and second laser receivers 56*a*, 56*b* each have laser receiving elements 58*a*, 58*b* affixed thereto near their second ends. The laser receiving elements 58*a*, 58*b* sense the elevation of a laser beam (set up at a construction site and not shown in the figures) which periodically moves in a horizontal plane to define a reference elevation for use by the site preparation/concrete finishing apparatus 20. A controller (not visible) electrically connects to the laser receiving elements 58*a*, 58*b* and hydraulically to the first and second finishing device hydraulic cylinders 54*a*, 54*b*. The controller receives signals from the laser receiving elements 58*a*, 58*b* and operates the first and second finishing device hydraulic cylinders 54*a*, 54*b* (i.e., causes the cylinders 54*a*, 54*b* to vertically extend or retract), as necessary, to maintain the second frame 52 (and the vibrating floats 60 and screed blade 68, described below) at a desired elevation relative to the elevation of the laser beam and, hence, at a desired elevation relative to the surface on which the movable vehicle 22 operates. The operation of laser elevation control systems is well-known in the art and, therefore, a more detailed discussion of the operation of the laser receiving elements 58*a*, 58*b* and the finishing device hydraulic cylinders 54*a*, 54*b* is not necessary herein.

The concrete finishing device 24 further comprises first and second vibrating floats 60*a*, 60*b* which connect to the second frame 52 and which extend in a, generally, downward vertical direction from the second frame 52 for contact with poured concrete when in use. A motor and drive assembly 62 mounts to the first laser receiver 56*a* (and, hence, to the second frame 52) near the vibrating floats 60 and connects to a cam shaft 64 which mounts to the second frame 52 for rotation by the motor and drive assembly 62. The cam shaft 64 extends laterally relative to the movable vehicle 22 and has a plurality of cams 66 rigidly affixed thereto which rotate, as the cam shaft 64 rotates, when the concrete finishing device 24 is in use. The cams 66 are positioned relative to the vibrating floats 60 so as to periodically engage the floats 60, thereby causing vibrating movement of the floats 60 relative to the second frame 52 (i.e., in a generally longitudinal direction defined between the ends 28, 30 of the movable vehicle 22) when the cam shaft 64 rotates. The concrete finishing device 24 additionally comprises a screed blade 68 which connects to the second frame 52 rearward of the location of the vibrating floats 60 and has a side away from the vibrating floats 60 with a substantially concave profile for contact with concrete poured at a position between the blade 68 and the front end 28 of the movable vehicle 22. Note that while the vibrating floats 60 and the screed blade 68 are shown in the figures as being connected to the second frame 52 at the same time, in actual use the vibrating floats 60 and the screed blade 68 have different widths (i.e., the vibrating floats 60 are wider than the screed blade 68) and the vibrating floats 60 are detached from the second frame 52 to enable the site preparation/concrete finishing apparatus 20 to operate within narrow areas in which the wider vibrating floats 60 would not fit. Further, in an alternate embodiment, the screed blade 68 is a first screed blade and the concrete finishing device 24 comprises a second screed blade located and attached forward of the vibrating floats 60 to enable pushing of dirt during fine grading as described below.

According to the preferred embodiment of the present invention, the concrete finishing device 24 additionally comprises a reciprocating float assembly 70 which is mounted to the first frame 50. The reciprocating float assembly 70 includes a motor and drive unit 72 positioned atop the first frame 50 and a shaft 74 which connects to the motor and drive unit 72 for rotation when the motor and drive unit 72 operates. The motor and drive unit 72 is, preferably, a reversible motor and drive unit 72 producing, during use, rotation of shaft 74 alternatingly in a clockwise direction for a period of time and then in a counterclockwise direction for a period of time. The shaft 74 extends laterally relative to the movable vehicle 22 and has ends 76*a*, 76*b* near which take-up reels 78*a*, 78*b* are rigidly attached to the shaft 74. The reciprocating float assembly 70 further includes a float member 80 and float booms 82*a*, 82*b* which rigidly attaches to the float booms 82*a*, 82*b*. The float member 80 extends substantially in a lateral direction relative to the movable vehicle 22 at a position forward of the remainder of the concrete finishing device 24 and has a substantially flat lower surface 84 for contact with the upper surface of screeded concrete (i.e., screeded by screed blade 68) when in use.

Each float boom 82*a*, 82*b*, as seen in FIG. 1, has first and second ends 86, 88, respectively, and extends in a substantially longitudinal direction forward of the movable vehicle 22 with the first ends 86*a*, 86*b* proximate the front end 28 of the movable vehicle 22 and with the second ends 88*a*, 88*b* attached to the float member 80 (and, hence, near the upper surface of screeded concrete when in use). Each float boom 82*a*, 82*b* has a cable 90*a*, 90*b* associated therewith and a first eye 92*a*, 92*b* located respectively near the second end 88*a*, 88*b* of the float boom 82*a*, 82*b* and the forwardmost edge 94 of the float member 80, a second eye 96*a*, 96*b* located respectively near the second end 88*a*, 88*b* of the float boom 82*a*, 82*b* and the rearmost edge 98 of the float member 80, and a third eye 100*a*, 100*b* located respectively near the first end 86*a*, 86*b* of the float boom 82*a*, 82*b*. Each cable 90*a*, 90*b* is secured to the respective first eye 92*a*, 92*b* of a float boom 82*a*, 82*b*, extends to and is threaded through the respective third eye 100*a*, 100*b* of a float boom 82*a*, 82*b*, and extends to and secures to the respective second eye 96*a*, 96*b* of a float boom 82*a*, 82*b* after wrapping a plurality of times around the respective take-up reel 78*a*, 78*b*. The concrete finishing device 24 further comprises a plurality of upper guide rollers 102*a*, 102*b* and a plurality of lower guide rollers 104*a*, 104*b* attached to the first frame 50. Each float boom 82*a*, 82*b* extends between (and, in operation, reciprocates between) a respective upper guide roller 102*a*, 102*b* and a respective lower guide roller 104*a*, 104*b*.

FIG. 4 displays a side, elevational view of a front wheel 26 of the site preparation/concrete finishing apparatus 20 in accordance with the preferred embodiment of the present invention. The front wheel 26 includes a hub 110 having a central axis 112 extending therethrough and a plurality of members 114 extending radially outward from said hub 110.

Figure 7:
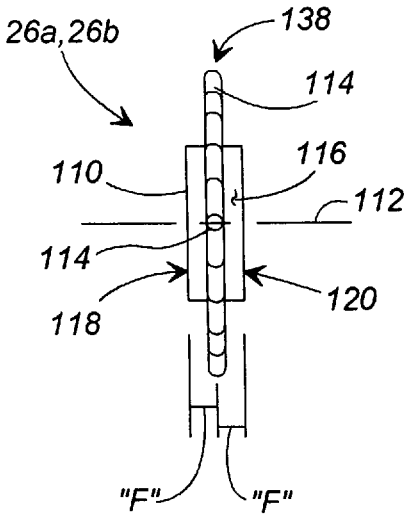
FIG. 7 is a schematic, side elevational view of a front wheel of the site preparation/concrete finishing apparatus of FIG. 1.
Figure 8:
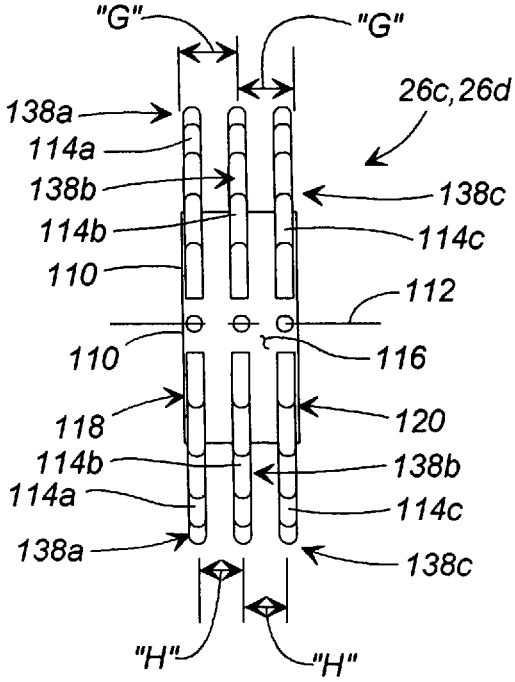
FIG. 8 is a schematic, side elevational view of a rear wheel of the site preparation/concrete finishing apparatus of FIG. 1.

The hub 110 has a rim surface 116 extending circumferentially about central axis 112 at a radius, "A", relative to the central axis 112 and has first and second ends 118, 120. The rim surface 116 extends laterally between the first and second ends 118, 120 of the hub 110 (see FIGS. 7 and 8). The hub 110 also has a relatively large hole 122 therethrough for receipt of an axle of the movable vehicle 22 and a plurality of relatively smaller holes 124 therethrough positioned, preferably, at equal angular offsets around the central axis 112 for receipt of studs used to secure the wheel 26 to the movable vehicle 22.

The members 114 of the plurality of members 114 are disposed, preferably, at equal angular offsets, "B", around the central axis 112 and extend between a first end 126 at the rim surface 116 and a second end 128 distal therefrom. As seen in FIGS. 5 and 6, each member 114 has a central axis 130 extending longitudinally between the ends 126, 128 of the member 114 and an arcuate surface 132 proximate the second end 128. Preferably, the arcuate surface 132 has a semi-spherical shape having a radius, "C". Each member 114 also has a lateral surface 134 extending about the central axis 130 and between the member's arcuate surface 132 and the member's first end 126. The lateral surface 134 is, preferably, located relative to central axis 130 at a radius, "D", near the member's first end 126 and at a radius, "E", near the intersection of the lateral surface 134 and the arcuate surface 132 (the circle of intersection being designated as 136 in FIGS. 5 and 6). Because radius, "D", is preferably larger than radius, "E", each member 114 tapers in diameter (and, hence, in cross-sectional area perpendicular to central axis 130) between the first end 126 and the intersection of the lateral and arcuate surfaces 134, 136, respectively. It is understood that the scope of the present invention includes members having different cross-sectional shapes perpendicular to central axis 130.

Note that, according to the preferred embodiment, the front wheels 26*a*, 26*b* and rear wheels 26*c*, 26*d* of the site preparation/concrete finishing apparatus 20 are substantially similar with two basic exceptions. First, the hubs 110 and members 114 of the front wheels 26*a*, 26*b* have, generally, smaller size dimensions than the hubs 110 and members 114 of the rear wheels 26*c*, 26*d*. Second, the front wheels 26*a*, 26*b*, as seen schematically in FIGS. 7 and 8, have a plurality of members 114 arranged in only one circumferential row 138 ringing their hubs 110, whereas the rear wheels 26*c*, 26*d* have first, second, and third pluralities of members 114*a*, 114*b*, 114*c*, respectively, arranged in three respective circumferential rows 138*a*, 138*b*, 138*c* ringing their hubs 100. As seen schematically in FIG. 7, the row 138 of members 114 of the front wheels 26*a*, 26*b* is positioned, preferably, at an equal distance, "F", from the ends 118, 120 of the hub 110. As seen schematically in FIG. 8, a central row 138*b* of members 114*b* of the rear wheels 26*c*, 26*d* is positioned, preferably, at an equal distance, "G", from the ends 118, 120 of the hub 110 and inner and outer rows 138*a*, 138*c* of members 114*a*, 114*c* are preferably positioned at equal offset distances, "H", measured from the central row 138*b* of members 114*b*.

Figure 9:
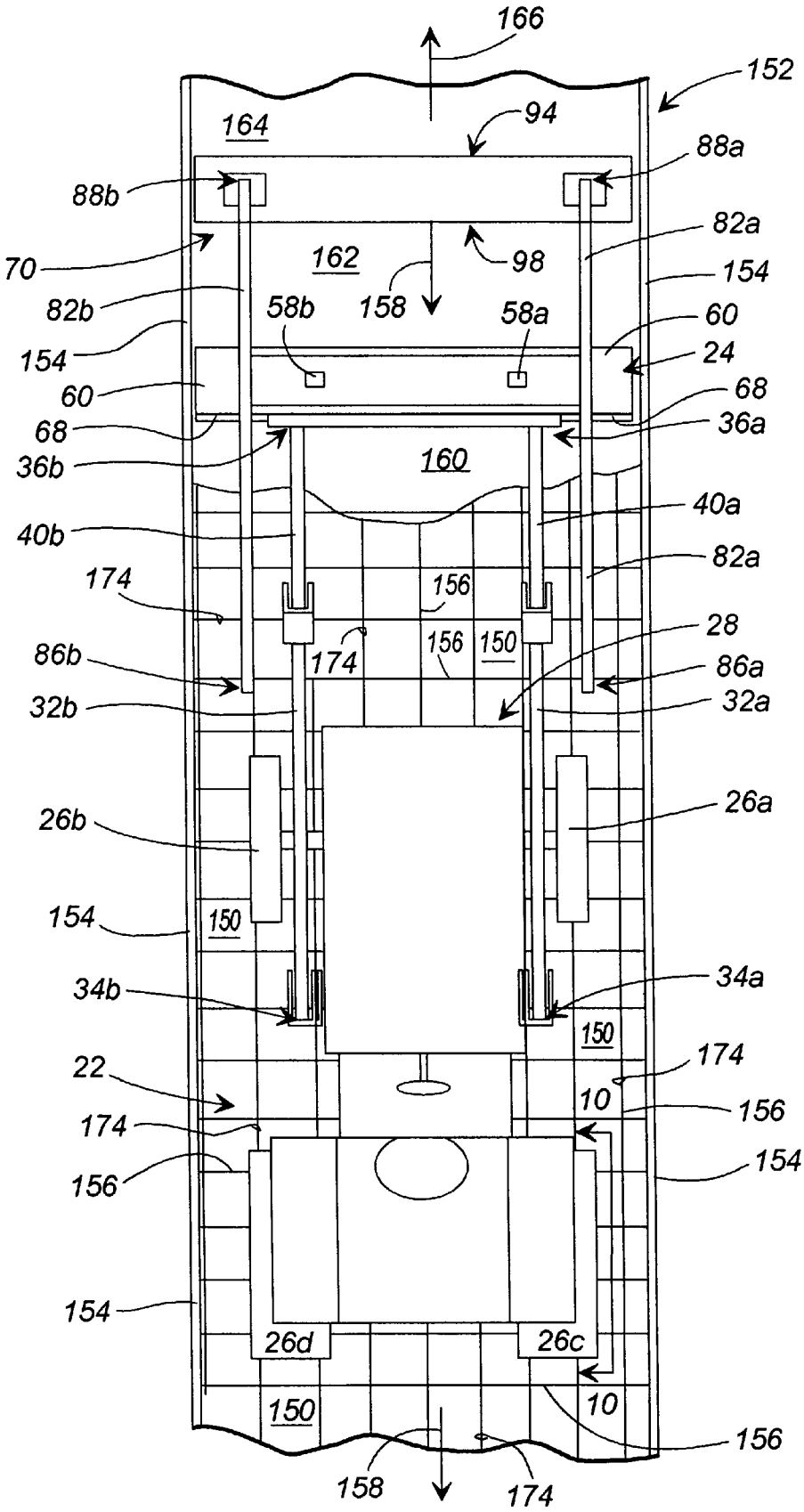
FIG. 9 is a schematic, top plan view of the site preparation/concrete finishing apparatus of FIG. 1 in use.

In accordance with a preferred method of the present invention, a rotating laser beacon (not shown) is set up near an area in which concrete is to be poured to form a roadway, driveway, floor slab, etc. The rotating laser beacon provides desired elevational reference signals and planes for use by the site preparation/concrete finishing apparatus 20. Once the rotating laser beacon is set up and is operational, the site preparation/concrete finishing apparatus 20 is positioned within the area In FIG. 9, the site preparation/concrete finishing apparatus 20 is positioned, for example, atop a somewhat elevationally level, dirt ground surface 150 in an area where a portion of a roadway 152 is being constructed. As the movable vehicle 22 is moved within the area, the laser receiving elements 58 periodically receive laser light emitted by the laser beacon (not shown) at a reference elevation for the dirt ground surface 150. The controller of the concrete finishing device 24 responds to received the laser light by actuating the finishing device hydraulic cylinders 54 to maintain the bottom of the screed blade 68 at a desired elevation relative to the reference elevation of the laser light. Actuation of the finishing device hydraulic cylinders 54 and maintenance of the desired elevation of the screed blade 68 by the controller during movement of the movable vehicle 22 in a rearward direction causes fine grading and leveling of the dirt ground surface 150 to the desired elevation. Because the movable vehicle 22 moves in a rearward direction, the wheels 26 of the site preparation/concrete finishing apparatus 20 do not travel over the dirt ground surface 150 after it is fine graded and, therefore, no ruts are created in the dirt ground surface 150.

Prior to repositioning of the site preparation/concrete finishing apparatus 20 within the area, wood forms 154 are fabricated and installed to define the lateral sides of the roadway 152. After fine grading and leveling of the dirt ground surface 150, reinforcing wire mesh 156 is located atop the dirt ground surface 150 between the forms 154 to provide structural reinforcement for the concrete which will substantially form the roadway 152.

According to the preferred method, the operator of the site preparation/concrete finishing apparatus 20 repositions the movable vehicle 22, after fine grading and leveling, atop the ground surface 150 to a position within the roadway construction area which is just downstream of where concrete is yet to be poured between the forms 154. The operator then actuates (by use of the movable vehicle's controls) the first and second lift arm hydraulic cylinders 38, 40, as appropriate, to move the second ends 36 of the vehicle's lift arms 32 to a position where the bottom of the screed blade 68 is located approximately at the elevation of the top of the forms 154 and just upstream of where concrete is to be poured between the forms 154. Once the screed blade 68 and, hence, the concrete finishing device 24 is appropriately positioned, concrete is continually poured between the forms 154 over the ground surface 150 and the reinforcing wire mesh 156 at a location between the front end 28 of the movable vehicle 22 and the concrete finishing device 24 to an elevation approximately equal to the elevation of the top of the forms 154. As the concrete is poured, the operator of the site preparation/concrete finishing apparatus 20 gradually moves the movable vehicle 22 in a reverse longitudinal direction (indicated in FIG. 9 by arrow 158) between the forms 154 and away from the newly poured and unfinished concrete 160. Continual movement of the vehicle 22 in the reverse longitudinal direction 158 causes the screed blade 68 of the concrete finishing device 24 to move over the newly poured and unfinished concrete 160 and to level off the upper surface of the concrete 160 at the desired elevation at which the screed blade 68 is maintained.

During movement of the movable vehicle 22 and pouring of the concrete, the laser receiving elements 58 periodically receive laser light emitted by the laser beacon (not shown) at a reference elevation for the desired elevation of the concrete surface. The controller of the concrete finishing device 24 responds to reception of the laser light by actuating the finishing device hydraulic cylinders 54 to maintain the bottom of the screed blade 68 and the bottom of the vibrating floats 60 at the desired elevation relative to the reference elevation of the laser light. Because operation of the laser beacon produces laser light at frequent time intervals in the area of the site preparation/concrete finishing apparatus 20 relative to the rearward speed of the movable vehicle 22, laser light received by the laser receiving elements 58 causes essentially continuous adjustment of the elevation of the concrete finishing device 24 relative to the ground surface 150. As the concrete finishing device 24 moves over the newly poured concrete 160 in the downstream longitudinal direction 158, the concrete 160 is (in addition to being screeded to the desired elevation by the screed blade 68) floated by the vibrating floats 60 to smooth the upper surface of the concrete 160, thereby producing semi-finished concrete 162 (i.e., concrete which has been screeded and floated) upstream of the concrete finishing device 24 between the vibrating floats 60 and the rearmost edge 98 of the float member 80 of the reciprocating float assembly 70.

According to the preferred method, the semi-finished concrete 162 is finished by further floating, performed by the reciprocating float assembly 70, to produce finished concrete 164 upstream of the forwardmost edge 94 of the float member 80. During movement of the movable vehicle 22, the motor and drive unit 72 of the reciprocating float assembly 70 operates to turn shaft 74 and, hence, take-up reels 78*a*, 78*b* in a first, clockwise rotational direction for a first period of time. Turning of the take-up reels 78*a*, 78*b* in a first, clockwise direction causes pulling of the portion of the cables 90*a*, 90*b* extending between the first eyes 92*a*, 92*b* and the take-up reels 78*a*, 78*b*, and slackening of the portion of the cables 90*a*, 90*b* extending between the second eyes 96*a*, 96*b* and the take-up reels 78*a*, 78*b*, thereby causing the float booms 82*a*, 82*b* to move in the downstream longitudinal direction 158 and, hence, causing the lower surface 84 of the float member 80 to move over the upper surface of the semi-finished concrete 162 in the downstream longitudinal direction 158. At the end of the first period of time, the motor and drive unit 72 of the reciprocating float assembly 70 then operates to turn shaft 74 and, hence, take-up reels 78*a*, 78*b* in a second, counterclockwise direction for a second period of time. The turning of the take-up reels 78*a*, 78*b* in the second, counterclockwise direction causes pulling of the portion of the cables 90*a*, 90*b* extending between the second eyes 96*a*, 96*b* and the take-up reels 78*a*, 78*b*, and slackening of the portion of the cables 90*a*, 90*b* extending between the first eyes 92*a*, 92*b* and the take-up reels 78*a*, 78*b*, thereby causing the float booms 82*a*, 82*b* to move in an upstream longitudinal direction 166 and, hence, causing the lower surface 84 of the float member 80 to move over the upper surface of the semi-finished concrete 162 in the upstream longitudinal direction 166. After expiration of the second period of time, the motor and drive unit 72 reverse their rotational direction and repeat the above-described process periodically, thereby producing a reciprocating motion of the float booms 82*a*, 82*b* and float member 80 relative to the upper surface of the semi-finished concrete 162 and producing finished concrete 164 upstream of the forwardmost edge 94 of the float member 80.

Figure 10:
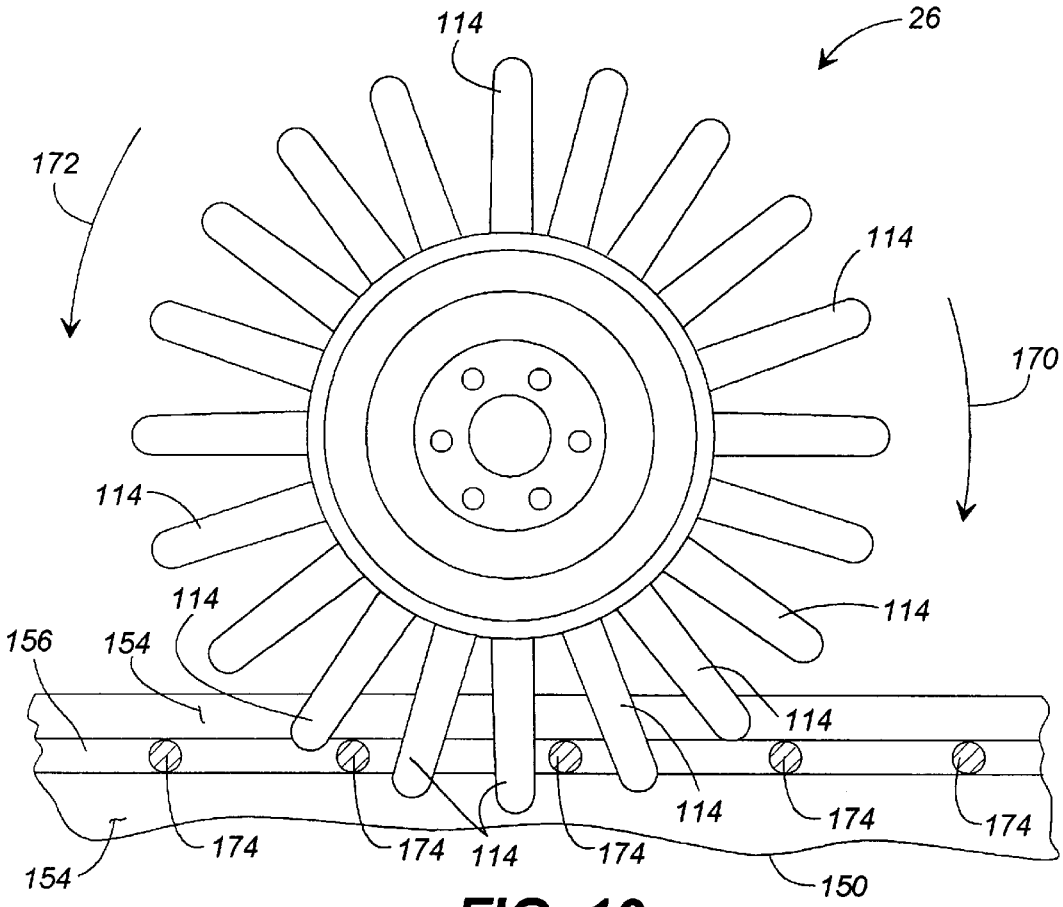
FIG. 10 is a partial, sectional view of FIG. 9 taken along section lines 10—10.

Note that when the movable vehicle 22 moves over the ground surface 150 between the forms 154 after the reinforcing wire mesh 156 is installed, the wheels 26 rotate in either a clockwise or counterclockwise direction 170, 172, respectively, with the members 114 of the wheels 26 alternatingly contacting the ground surface 150 as illustrated in the schematic cross-sectional view of FIG. 10. As the wheels 26 rotate, the members 114, depending on the relative positions of the members 114 and wires 174 of the reinforcing wire mesh 156, either (i) contact the wires 174 generally to the right or left of the central axis 130 of a member 114 (see respective FIGS. 11 and 14) before contacting the ground surface 150 or (ii) fail to contact the wires 174 before contacting the ground surface 150.

Figure 11:
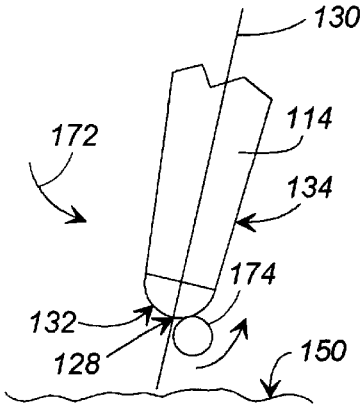
FIG. 11 is a partial, schematic, side elevational view of a member of a wheel of the site preparation/concrete finishing apparatus of FIG. 9 in use at a first time where a reinforcing wire initially contacts the member to the right of the member's central axis.
Figure 12:
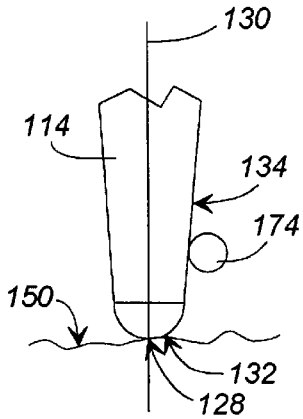
FIG. 12 is a partial, schematic, side elevational view of the member of the wheel of the site preparation/concrete finishing apparatus of FIG. 11 in use at a second time.
Figure 13:
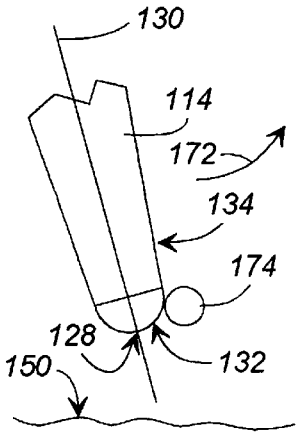
FIG. 13 is a partial, schematic, side elevational view of the member of the wheel of the site preparation/concrete finishing apparatus of FIG. 11 in use at a third time.

FIGS. 11–13 schematically illustrate, in a time lapse manner, the cooperation between a member 114 of a wheel 26 rotating in a counterclockwise direction 172 and a wire 174 of the reinforcing wire mesh 156. In FIG. 11, the wire 174 impacts the arcuate surface 132 of the member 114 to the right of the member's central axis 130 and near the member's second end 128. As the wheel 26 rotates, the second end 128 of the member moves elevationally downward into contact with the ground surface 150 (see FIG. 12) with the wire 174 sliding relative to the member 114 first adjacent to the arcuate surface 132 and then adjacent to the lateral surface 134. Upon further continued rotation of the wheel 26, the second end 128 of the member 114 moves elevationally upward and out of contact with the ground surface 150 (see FIG. 13) with the wire 174 sliding relative to the member 114 first adjacent to the lateral surface 134 and then adjacent to the arcuate surface 132.

Figure 14:
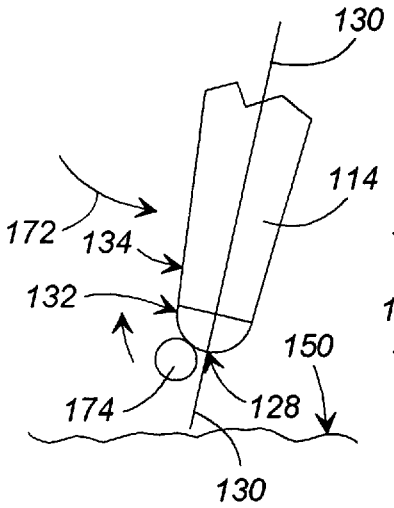
FIG. 14 is a partial, schematic, side elevational view of a member of a wheel of the site preparation/concrete finishing apparatus of FIG. 9 in use at a first time where a reinforcing wire initially contacts the member to the left of the member's central axis.
Figure 15:
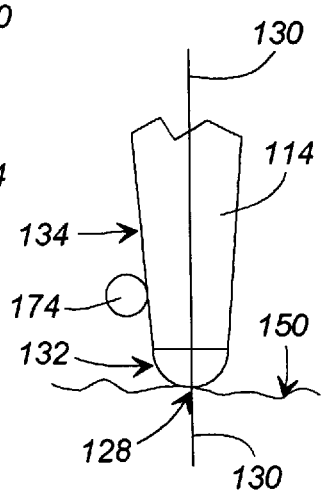
FIG. 15 is a partial, schematic, side elevational view of the member of the wheel of the site preparation/concrete finishing apparatus of FIG. 14 in use at a second time.
Figure 16:
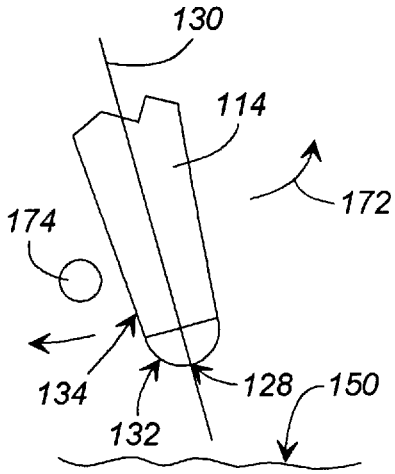
FIG. 16 is a partial, schematic, side elevational view of the member of the wheel of the site preparation/concrete finishing apparatus of FIG. 14 in use at a third time.

FIGS. 14–16 schematically illustrate, in a time lapse manner similar to that of FIGS. 11–13, the cooperation between a member 114 of a wheel 26 rotating in a counterclockwise direction 172 and a wire 174 of the reinforcing wire mesh 156 where the wire 174 first contacts the arcuate surface 132 of the member 114 to the left of the member's central axis 130 and near the member's second end 128 (see FIG. 14). Then, the wheel 26 continues to rotate with the member 114 becoming positioned, as shown in FIG. 15, where the second end 128 of the member 114 contacts the ground surface 150 and the wire 174 has slid relative to the arcuate and lateral surfaces 132, 134 adjacent the portion of the member 114 to the left of the member's central axis 130. Continued rotation of the wheel 26 causes the second end 128 of the member 114 to move elevationally upward to no longer contact the ground surface 150 and into the position shown in FIG. 16 where the member 114 and the wire 174 are no longer in contact.

Note that the arcuate surface 132 and tapering of the member 114 in the area of the lateral surface 134 enables relative movement between the member 114 and the wire 174 which might not, otherwise, occur if the member 114 were flat at its second end 128 and non-tapered between its ends 126, 128. By enabling relative movement and interaction between the wire 174 and member 114, the arcuate and tapered lateral surfaces 132, 134 allow the member 114 (and, hence, the wheels 26 of the site preparation/concrete finishing apparatus 20) to take advantage of the flexibility of the reinforcing wire 174 and to not permanently bend downward or damage the reinforcing wire mesh 156 through direct downward contact of the wire 174 by the member 114 and trapping of the wire 174 between the second end 128 of the member 114 and the ground surface 150. The arcuate and tapered lateral surfaces 132, 134 further allow the reinforcing wire 174 to displace between a first original position and a second temporary position before enabling the reinforcing wire 174 to resume its first original position after cessation of contact with the member 114.

Whereas this invention has been described in detail with particular reference to its most preferred embodiments, it is understood that variations and modifications can be effected within the spirit and scope of the invention, as described herein before and as defined in the appended claims. The corresponding structures, materials, acts, and equivalents of all means plus function elements, if any, in the claims below are intended to include any structure, material, or acts for performing the functions in combination with other claimed elements as specifically claimed.

I claim:

1. A wheel for supporting a concrete processing vehicle, said wheel comprising:

a hub portion rotatably mountable to a concrete processing vehicle to be operated within the confines of an area prepared to receive concrete, wherein the area has a base surface atop which concrete is poured and at least one concrete reinforcing element located above the base surface, wherein said hub portion has a first end and a second end distal thereto and said first and second ends define a central axis extending therebetween, and wherein said hub portion includes a rim surface extending radially about said central axis and between said first and second ends; and, a plurality of base surface-contacting members extending from said hub portion, each base surface-contacting member of said plurality of base surface-contacting members having a shape which urges a concrete reinforcing element away from entrapment between said base surface-contacting member and the base surface upon contact between said base surface-contacting member and the concrete reinforcing element, wherein each said base surface-contacting member is elongated and has a first end at said rim surface and a second end distal thereto.

2. The wheel of claim 1, wherein each said base surface-contacting member of said plurality of base surface-contacting members includes an elongate portion which promotes sliding relative motion with a concrete reinforcing element thereagainst.

3. The wheel of claim 2, wherein each said base surface-contacting member defines a longitudinal axis extending between said first and second ends thereof, wherein said elongate portion of each said base surface-contacting member has a surface offset relative to said longitudinal axis at progressively increasing distances at locations of said surface progressively nearer said rim surface, and wherein each said base surface-contacting member has an arcuate surface proximate said second end thereof.

4. The wheel of claim 1, wherein each said base surface-contacting member of said plurality of base surface-contacting members defines a longitudinal axis extending between said first and second ends thereof and said shape of each said base surface-contacting member is formed so as to displace a concrete reinforcing element in a direction away from said longitudinal axis upon contact between the concrete reinforcing element and said base surface-contacting member.

5. The wheel of claim 4, wherein said shape of each said base surface-contacting member tapers between a first location of each said base surface-contacting member near said rim surface and a second location of each said base surface-contracting member distant from said rim surface.

6. The wheel of claim 5, wherein each said base surface-contacting member has a cross-section at said first location and a cross-section at said second location, said cross-section at said first location being larger than said cross-section at said second location.

7. The wheel of claim 4, wherein said shape of each said base surface-contacting member is curved relative to said longitudinal axis at a location proximate said second end thereof.

8. An apparatus for finishing concrete operable within an area prepared to receive concrete wherein the area includes a base surface above which at least one concrete reinforcing element is located, said apparatus comprising:

a movable vehicle including a plurality of wheels mounted for rotation, wherein said wheels of said plurality of wheels are operable to entirely support said movable vehicle relative to the base surface and to enable movement of said movable vehicle within the confines of the area prepared to receive concrete absent displacement of a portion of a concrete reinforcing element from a first position to a second position from which the portion of the concrete reinforcing element cannot by itself resume the first position; and, a concrete finishing device operatively connected to said movable vehicle.

9. The apparatus of claim 8, wherein each wheel of said plurality of wheels includes a plurality of base surface-contacting members extending therefrom, and wherein each base surface-contacting member of said plurality of base surface-contacting members has a longitudinal axis and includes a portion configured to direct a concrete reinforcing element in a direction generally away from said longitudinal axis upon contact between the concrete reinforcing element and said portion of said base surface-contacting member.

10. The apparatus of claim 9, wherein said portion includes a lateral surface which tapers relative to said longitudinal axis.

11. The apparatus of claim 10, wherein said portion has a substantially circular cross-section relative to said longitudinal axis.

12. The apparatus of claim 9, wherein said portion includes an end of said base surface-contacting member and a curved surface proximate said end.

13. The apparatus of claim 8, wherein said apparatus further includes a positioning apparatus connected to said concrete finishing device and responsive to an elevation reference signal, said concrete finishing device being positionable by said positioning apparatus at a desired elevation relative to the elevation reference signal.

14. The apparatus of claim 8, wherein said concrete finishing device includes a screed.

15. The apparatus of claim 8, wherein said concrete finishing device includes a float member positioned beyond an end of said movable vehicle, said float member being operable for movement in reciprocating motion relative to said movable vehicle.

16. A method of producing finished concrete, the method comprising the steps of:

positioning a movable vehicle having a plurality of wheels and a concrete finishing device operably attached thereto within the confines of an area configured to receive concrete, wherein the area includes a base surface and at least one concrete reinforcing element located above the base surface, wherein the wheels of the plurality of wheels contact the base surface and entirely support the movable vehicle, and wherein each wheel of the plurality of wheels has a protruding member for urging a concrete reinforcing element away from entrapment between the wheel and the base surface;

moving the movable vehicle within the confines of the area and with the plurality of wheels in contact with the base surface;

pouring concrete within the area; and, finishing concrete poured in the area with the concrete finishing device.

17. The method of claim 16, wherein the method further comprises a step of, in the event contact is made between a wheel of the movable vehicle and a concrete reinforcing element, displacing by the wheel of the movable vehicle of at least a portion of the concrete reinforcing element from an initial first position to a temporary second position in a manner that enables the concrete reinforcing element to substantially resume the initial first position after cessation of contact with the wheel of the movable vehicle.

18. The method of claim 17, wherein the concrete reinforcing element is not trapped between the wheel of the movable vehicle and the base surface when in the temporary second position.

19. The method of claim 17, wherein the step of displacing includes a step of moving at least a portion of the concrete reinforcing element adjacent and relative to the protruding member of the wheel of the movable vehicle during contact between the concrete reinforcing element and the wheel.

20. The method of claim 16, wherein the step of moving includes continuously moving the movable vehicle within the confines of the area and in contact with the base surface absent deformation of a concrete reinforcing element.

21. The method of claim 16, wherein the step of moving includes continuously moving the movable vehicle within the confines of the area and in contact with the base surface absent lasting alteration of a position of a concrete reinforcing element.

* * * * *